US005242129A

United States Patent [19]

Bailey et al.

[11] Patent Number: 5,242,129

[45] Date of Patent: Sep. 7, 1993

[54] KNOCKDOWN CABLE REEL

[76] Inventors: A. Cole Bailey, 5210 Dylan Way, Summerfield, N.C. 27358; Andrew D. Baughman, 4003 Plantation Dr., Greensboro, N.C. 27410

[21] Appl. No.: 878,963

[22] Filed: May 6, 1992

[51] Int. Cl.[5] ..... B65H 75/22

[52] U.S. Cl. ..... 242/115

[58] Field of Search ..... 242/115, 116, 71.8, 242/77, 77.3, 117, 118.8

[56] References Cited

U.S. PATENT DOCUMENTS

| | | | |
|---|---|---|---|
| 2,824,707 | 2/1958 | Kennedy | 242/118.8 |
| 3,297,154 | 1/1967 | Lyman | 242/71.8 |
| 3,704,838 | 12/1972 | Bernier et al. | 242/115 X |
| 3,827,651 | 8/1974 | Benson et al. | 242/115 |
| 3,830,445 | 8/1974 | Moore | 242/115 X |
| 4,066,224 | 4/1978 | Hargreaves et al. | 242/115 |
| 4,471,919 | 9/1984 | Leunig | 242/118.4 |
| 4,620,676 | 11/1986 | Missalla | 242/115 X |
| 4,895,316 | 1/1990 | Salloum | 242/71.8 |

FOREIGN PATENT DOCUMENTS

| | | | |
|---|---|---|---|
| 714420 | 4/1965 | Canada | 242/77.3 |
| 1396108 | 3/1965 | France | 242/118.8 |

*Primary Examiner*—Daniel P. Stodola
*Assistant Examiner*—Eileen Dunn

[57] ABSTRACT

A knockdown cable reel for storage of electrical cable including a central drum with radially extending flanges positioned on each end. The flanges are formed from a plurality of segments to facilitate assembly and disassembly. A flange ring encircles the outer periphery of each flange to stabilize the flange during use.

14 Claims, 4 Drawing Sheets

KNOCKDOWN CABLE REEL

BACKGROUND OF THE INVENTION

1 Field of the Invention

The invention herein pertains to cable reels for electrical cables as utilized by utility companies and others for packaging or storage and transportation of commercial and industrial electrical wires and cables. The reel described herein is more specifically of the "knockdown" type which can be easily and quickly disassembled for transportation or storage when empty and not in use and assembled for later reuse.

2. Description of the Prior Art and Objectives of the Invention

Various types of reels and spools have been used in the past by electrical contractors, telephone and power companies to store and transport various types of electrical wires and other cables. Originally such reels generally consisted of wooden structures which were permanently assembled. In recent years reels of the "knockdown" variety have been designed which increases their utility and convenience in handling and returning for rewinding with a new supply of cable. Such knockdown reels are more convenient than conventional reels but have been unwieldy and difficult to manipulate, especially with sizes which have flanges exceeding thirty-six inches in diameter. Thus, it is an objective and one advantage of the present invention to provide a reel for storing wound cable thereon which can be assembled for holding cable and disassembled as required for shipment or storage with the cable removed therefrom.

It is another objective of the present invention to provide a knockdown reel which includes a plurality of flange segments which slidably attach to the drum head.

It is yet another objective of the present invention to provide a knockdown reel which includes exterior flange rings which hold and stabilize the flange after assembly.

It is still another objective of the present invention to provide a knockdown reel which is structurally strong and yet light in weight relative to conventional reels.

It is also an objective of the present invention to provide a knockdown reel which can be quickly assembled and disassembled for reuse as required.

Various other objectives and advantages of the present invention will become apparent to those skilled in the art as a more detailed description is presented below.

SUMMARY OF THE INVENTION

The aforesaid and other objectives are realized by providing a knockdown cable reel which includes a cylindrical drum having a pair of flanges positioned on drum heads at each end. The flanges comprise a series of segments which are slidably positioned within sockets attached to drum heads. The drum may be formed of a polymeric material or a relatively thin gauge steel of suitable thickness such as by welding and the drum heads and flanges may be molded from a polymeric material such as a conventional polycarbonate. Upon assembly on the flange a flange ring is placed around the outer periphery of each of the flange segments to stabilize the segments and maintain integrity of the flange during periods of use, such as rolling or unwinding cable therefrom.

DESCRIPTION OF THE PREFERRED EMBODIMENT

Figure 1:
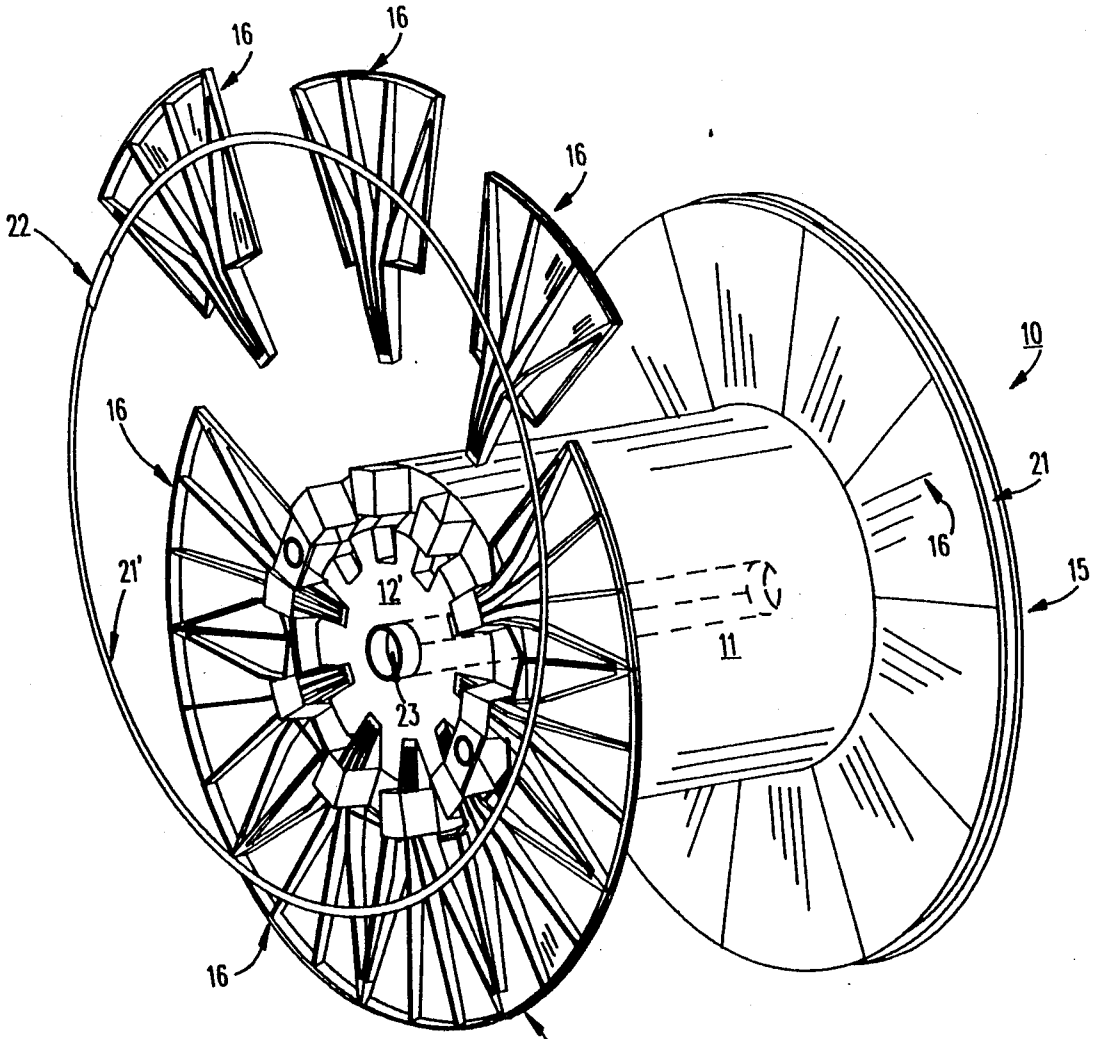
FIG. 1 demonstrates a perspective view of the reel with one flange exploded for clarity.

The preferred form of the invention is shown in FIG. 1 whereby a knockdown cable reel consists of a pair of segmented flanges which slidably engage drum heads positioned within the cylindrical drum. The flange segments are light in weight and comprise a plurality of ribs for structural integrity. Each segment has an upper large main body portion and a lower blade portion for insertion into a drum head socket. A stabilizing band or ring is placed around the flange periphery upon assembly to stabilize and hold the flange segments in position and to increase the load bearing ability of the reel. The flange ring may be formed from metal or other suitable materials and rests with the flange ring grooves.

DETAILED DESCRIPTION OF THE DRAWINGS AND OPERATION OF THE INVENTION

Figure 4:
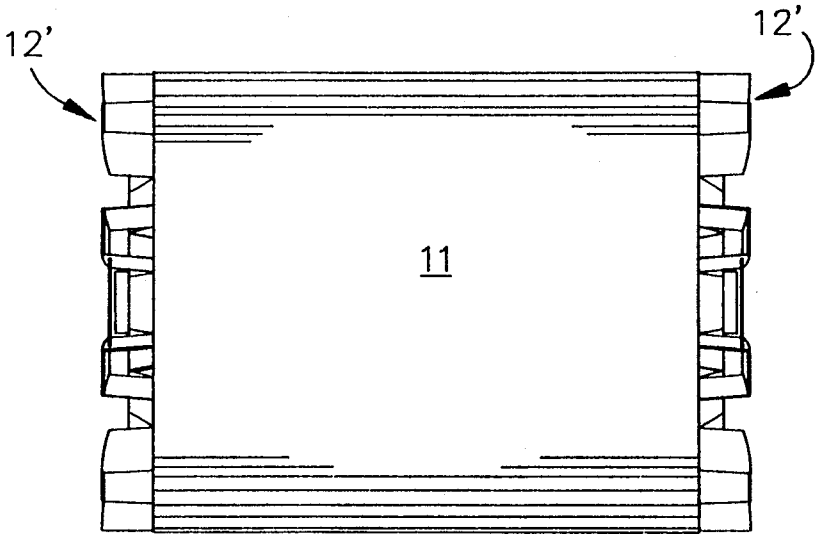
FIG. 4 pictures the drum with drum heads inserted therein.
Figure 5:
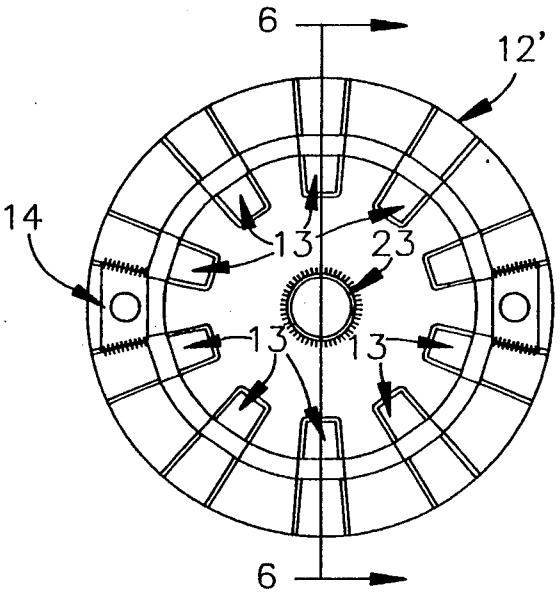
FIG. 5 presents a front plan view of one drum head.
Figure 6:
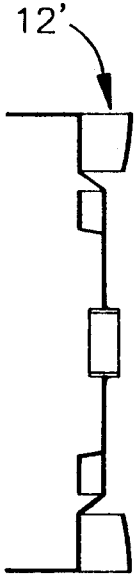
FIG. 6 depicts a side view of the drum head along lines 6—6 as shown in FIG. 5.

For a more complete understanding of the invention and its operation, turning now to the drawings, knockdown reel 10 as shown in FIG. 1 comprises a drum 11 which may be formed from an extruded polymeric material, rolled steel or aluminum sheeting which has been welded and may have a diameter of approximately twenty-four inches and a length of approximately thirty-three inches. As would be understood, other diameters and sizes can be manufactured, depending on the particular cable size and length to be wound and packaged or stored on reel 10. Drum heads 12, 12' are inserted into each end of drum 11 as perhaps more clearly shown in FIG. 4. Drum head 12' as seen in FIG. 5 has a diameter of approximately twenty-four inches and is configured as shown in FIG. 4 to slip partially within the end of drum 11. Drum heads 12, 12' may be formed from a suitable metal or a polymeric material of substantial strength such as a suitable nylon, polycarbonate or other material. As further seen in FIG. 5, drum head 12' includes a plurality of ten sockets 13 as will be explained in more detail below. Also, drum head 12' includes a pair of drive apertures 14 which can be used for tensioning wire as it is rolled from reel 10, for example with an axle placed through central drum opening 23. In FIG. 6, a cross-sectional view along lines 6—6 of FIG. 5 is shown to illustrate the cross-sectional configuration of drum head 12'.

Figure 3:
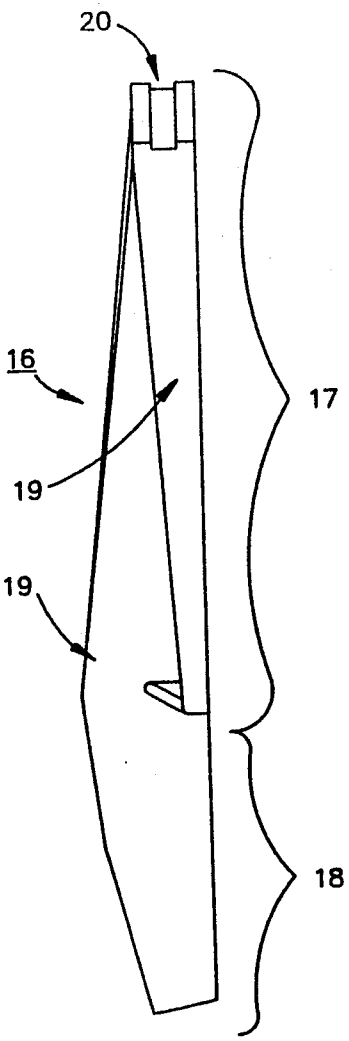
FIG. 3 shows the segment in FIG. 2 in a right side elevational view.
Figure 2:
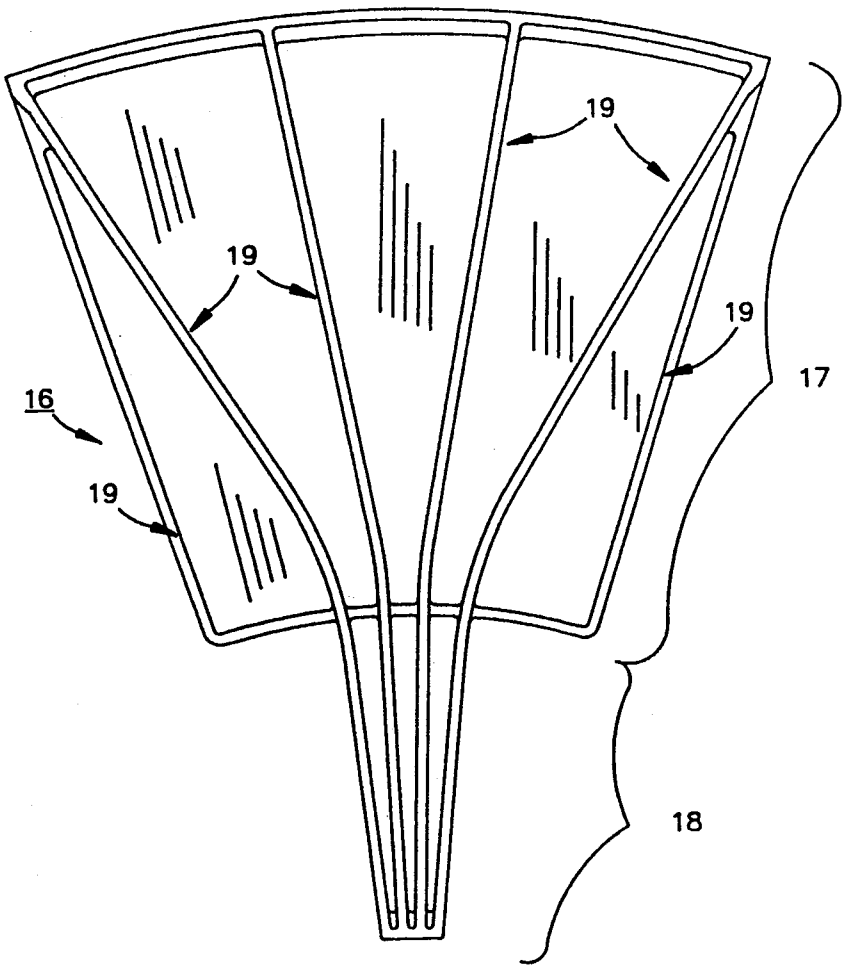
FIG. 2 illustrates a front plan view of one of the flange segments.

As seen in FIG. 1, reel 10 includes a pair of flanges 15, 15' attached at each end of drum 11. Flange 15' as shown in FIG. 1 comprises a plurality of ten flange segments 16 which are formed from a polymeric material such as polycarbonate/PBT as known in the industry or from other suitable materials. Polycarbonate has been selected based on its structural integrity, durability and relatively low weight. As would be understood other suitable metals or polymeric materials could likewise be used. Flange segment 16 comprises an upper body 17 as shown in FIG. 2 and a relatively small lower blade 18. Ribs 19 form main body 17 and lower blade 18 of flange segment 16 to reduce the weight while maintaining structural strength. End ribs 19' may have a means to attach one to another, such as a tongue and groove or other configuration. In FIG. 3, the top of segment 16 is shown which includes a groove 20 for receiving flange ring 21 as seen in FIG. 1. Flange rings 21, 21' may from thin, flat steel straping or may be formed from nylon or the like. Flange ring 21' as shown in FIG. 1 includes a connector 22 which has been pressed onto ring 21' to hold ring 21' together. Ring 21' as shown in FIG. 1 is urged over flange 15' to maintain segments 16 securely therein whereby reel 10 can be rolled, moved, unwound, transported and the like without concern for maintaining the integrity and stability of segmented reel flanges 15, 15'.

Figure 7:
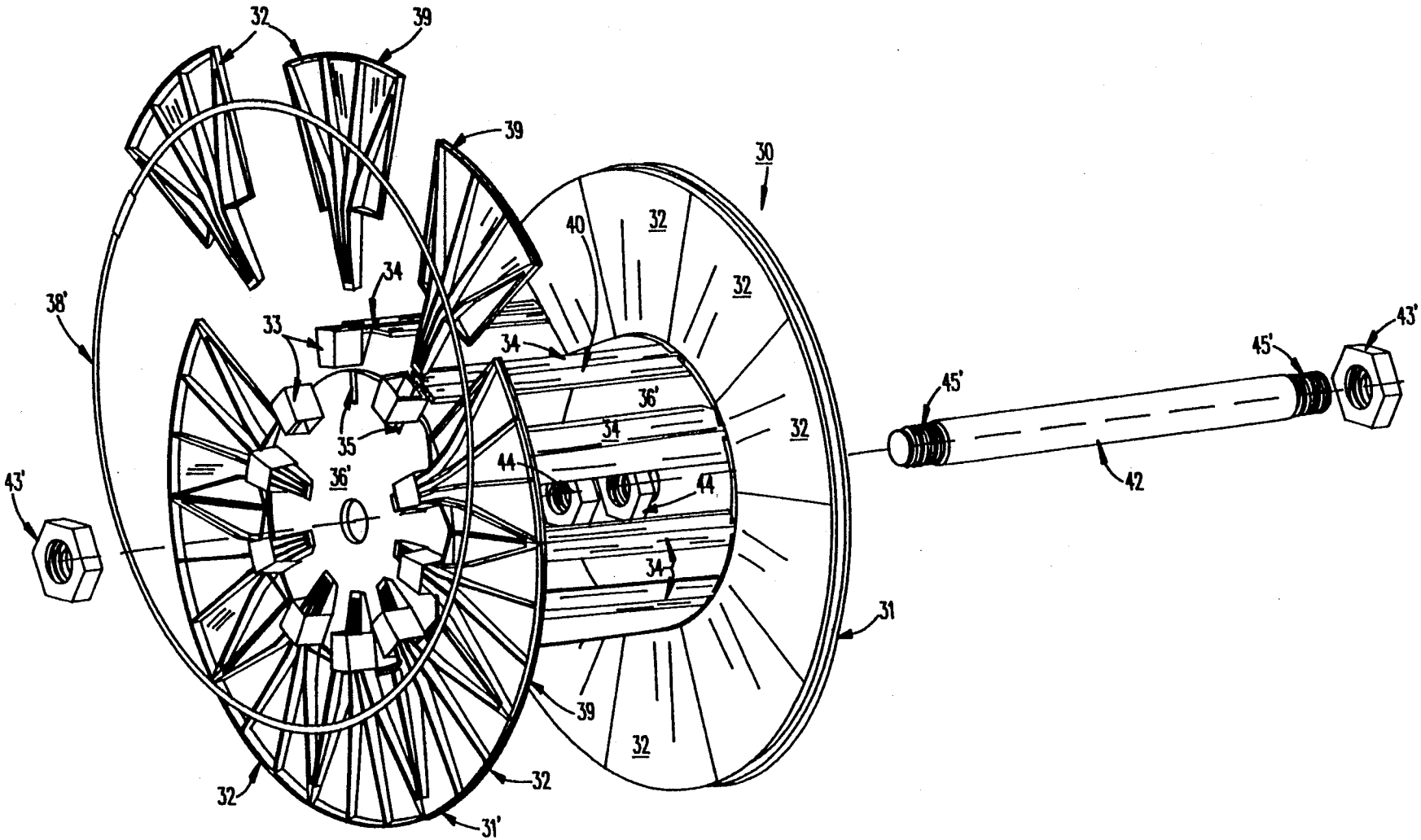
FIG. 7 shows in exploded fashion another embodiment of a knockdown reel.

In FIG. 7 another embodiment is seen in which knockdown reel 30 is shown in partially exploded form. Flanges 31, 31' are formed from a plurality of segments 32 which may be constructed as earlier discussed regarding segments 16. Segments 32 being somewhat triangular shaped are positioned within sockets 33 which are attached to drum slats 34. Drum slats 34 are slidably received within slots 35, 35' (not shown) of drum heads 36, 36'. Thus, drum heads 36, 36' and drum slats 34 with affixed sockets 33 comprise drum 40. Knockdown reel 30 can be completely disassembled and stacked in a relatively small space since drum 40 can be completely disassembled. Once segments 32 are positioned within sockets 33 as shown in FIG. 7, flange rings 38, 38' are urged over flanges 31, 31' and into ring grooves 39. To provide additional strength and rigidity to reel 30, axle 42 which also may be formed from suitable metallic or polymeric compositions is positioned through drum 40 and secured therein by external locking nuts 43, 43' and internal locking nuts 44, 44'. As would be understood, locking nuts 43, 43', 44, and 44' are tightenable on threads 45, 45' of axle 42. As hereinbefore mentioned, flange segments 32 may also include tongue and grooved end ribs or other means to attach one to another as desired.

The illustrations and examples provided herein are for explanatory purposes and are not intended to limit the scope of the appended claims.

We claim:

1. A reel comprising: a drum, drum heads attached to opposite ends of said drum, a pair of flanges, said flanges positioned on opposite ends of said drum, one of said flanges comprising a plurality of segments, said segments attached to one of said drum head, a flange ring, said ring encircling said flange segments at the outer periphery thereof.

2. A reel as claimed in claim 1 wherein said flange segments are somewhat triangular shaped.

3. A reel as claimed in claim 1 wherein said flange segments define a ring groove.

4. A reel as claimed in claim 1 wherein said flange segments are ribbed.

5. A reel as claimed in claim 1 wherein said drum head defines a flange socket.

6. A reel as claimed in claim 1 wherein said drum head defines a drive aperture.

7. A reel as claimed in claim 1 wherein each of said flange segments comprise a main body and a blade, said blade attached to said main body.

8. A knockdown reel comprising: a drum, a pair of drum heads, said drum heads mounted on opposite ends of said drum, said drum heads each defining a plurality of flange sockets, a plurality of flange segments, each of said segments comprising a main body and a segment blade, said blade attached to said main body, each said blade positionable within a respective one of said flange sockets, each of said flange segments defining a ring groove, and a pair of flange rings, whereby said rings are inserted into said ring grooves to encircle said flange segments to stabilize said flanges.

9. A knockdown reel as claimed in claim 8 wherein said drum heads each define a drive aperture.

10. A knockdown reel as claimed in claim 8 wherein each main body of said flange segments comprises a rib.

11. A knockdown reel as claimed in claim 8 wherein said flange segments are formed from a polymeric material.

12. A knockdown reel as claimed in claim 8 wherein said drum heads are formed from a polymeric material.

13. A knockdown reel as claimed in claim 8 wherein said drum heads are formed from a metal.

14. A knockdown reel for storage of electrical cable comprising: a drum, said drum comprising a plurality of slats, a plurality of flange sockets, said sockets attached to the ends of said drum slats, a pair of flanges, said flanges positioned on opposite ends of said drum, said flanges comprising a plurality of segments, said segments positioned within said sockets.

* * * * *